US006796704B1

(12) United States Patent
Lott

(10) Patent No.: US 6,796,704 B1
(45) Date of Patent: Sep. 28, 2004

(54) APPARATUS AND METHOD FOR MIXING COMPONENTS WITH A VENTURI ARRANGEMENT

(76) Inventor: W. Gerald Lott, 6611 Portwest Dr., Suite 140, Houston, TX (US) 77024

( * ) Notice: Subject to any disclaimer, the term of this patent is extended or adjusted under 35 U.S.C. 154(b) by 0 days.

(21) Appl. No.: 09/588,210

(22) Filed: Jun. 6, 2000

(51) Int. Cl.[7] ..... B01F 15/02

(52) U.S. Cl. ..... 366/163.2; 366/165.2; 366/178.1

(58) Field of Search ..... 366/177, 163.2, 366/165.1, 165.2, 165.5, 167.1, 174.1, 175.2, 176.1, 178.1, 178.2, 178.3, 181.1; 137/888

(56) References Cited

U.S. PATENT DOCUMENTS 1,982,479 A * 11/1934 Ober et al.
3,298,669 A * 1/1967 Zingg
3,542,342 A * 11/1970 Barron
3,741,533 A * 6/1973 Winn, Jr.
3,994,480 A * 11/1976 Fothergill et al.
4,186,772 A 2/1980 Handleman
4,345,841 A * 8/1982 Day
4,390,284 A * 6/1983 Hyde et al.
4,407,456 A 10/1983 Daniel et al.
4,531,673 A * 7/1985 Holland et al.
4,538,921 A * 9/1985 Kennedy
4,662,759 A * 5/1987 Leibee et al.
4,688,945 A * 8/1987 Brazelton et al.
4,884,925 A 12/1989 Kemp et al.
4,971,768 A 11/1990 Ealba et al.
5,145,256 A 9/1992 Wiemers et al.
5,165,452 A 11/1992 Cheng
5,190,374 A * 3/1993 Harms et al.
5,195,851 A 3/1993 Shepard et al.
5,305,610 A 4/1994 Bennett et al.
5,350,543 A 9/1994 Spradley
5,382,411 A * 1/1995 Allen
5,447,394 A 9/1995 Shepard
5,507,573 A * 4/1996 Hiorth
5,549,422 A 8/1996 Shepard
5,571,281 A * 11/1996 Allen
5,660,466 A * 8/1997 Hopson et al.
5,716,006 A 2/1998 Lott
5,857,773 A * 1/1999 Tammelin
5,860,451 A * 1/1999 Raleigh et al.
5,927,338 A 7/1999 Boticki et al.
5,979,517 A * 11/1999 Wilson
6,024,874 A 2/2000 Lott
6,045,255 A * 4/2000 Ogier
6,357,906 B1 * 3/2002 Baudoin et al. ..... 366/163.2

FOREIGN PATENT DOCUMENTS

EP 50312 * 4/1982

* cited by examiner

*Primary Examiner*—Charles E. Cooley
(74) *Attorney, Agent, or Firm*—Loren Helmreich; Browning Bushman, P.C.

(57) ABSTRACT

An eductor mixing device (10) has a main body or housing (28) of a generally cylindrical shape and an inner tube (42) for one component to be mixed with a liquid is mounted in main body (28) with a vortex chamber (56) formed in an annulus between the main body (28) and the inlet flow tube (42). Pressurized liquid enters the vortex chamber through a generally rectangular entrance opening (36) along an arcuate surface (42) which smoothly merges with the cylindrical surface (30) of the main body or housing (28). A liquid in a swirling motion moves in a descending helical path about inner tube (42) and passes through a gap G between coaxial frusto-conical surfaces (55) and (68) of the converging inner nozzle (52) of the inner tube (42) and an outer coaxial liquid nozzle (60) of diffuser ring (58) . A high velocity is created by the swirling liquid for exerting a suction or negative pressure at the lower end of inner nozzle (52) to draw the component to be mixed, such as a particulate material, into the swirling liquid stream where the swirling liquid and particulate material form a strong vortex to create a slurry in a minimal travel distance after passing inner converging nozzle (52) of particulate inner tube (42).

20 Claims, 7 Drawing Sheets

APPARATUS AND METHOD FOR MIXING COMPONENTS WITH A VENTURI ARRANGEMENT

FIELD OF THE INVENTION

This invention relates to a mixing system for mixing two separate components or constituents, and more particularly to an apparatus and method for an eductor system for mixing two separate components one of which is a liquid.

BACKGROUND OF THE INVENTION

An eductor mixer system is effective in continuously mixing two separate constituents such as liquids and particulate materials to form a slurry. The term "slurry" is interpreted herein as including dispersions and solutions. The term "particulate material" is interpreted herein for all purposes as including granular materials, powdered materials, and other pressure fluidizable transportable materials. The eductor mixer system thoroughly mixes the liquid with the particulate material and obtains a relative high negative pressure or vacuum level which is efficiently generated to positively draw or suck the particulate material into the eductor system. The working liquid fluid is directed through a nozzle to produce a high velocity. The high velocity liquid stream creates a low pressure region adjacent the downstream end of a nozzle for the particulate material. The low pressure zone causes the particulate material to be drawn or sucked through a suction port into a mixing chamber created by the swirling liquid stream adjacent the nozzle for the particulate material.

U.S. Pat. No. 4,186,772 issued Feb. 5, 1980 shows an eductor mixer system which is used to mix a powered solute with a liquid solvent. The eductor mixer system shown therein is effective in mixing continuous or batch preparations of a dry material with a liquid with the liquid working fluid being thoroughly and intimately mixed with the dry powdered solute. A relatively high vacuum or low pressure level is obtained to draw or suck the powered material into the system. While a relatively small gap or orifice is provided for a rapid acceleration of the working fluid flowing axially through the orifice in the '772 patent, there is no showing or suggestion of providing a swirling action to the liquid prior to being mixed with the dry powdered material as an axial flow of the liquid working fluid is provided.

U.S. Pat. No. 4,884,925 issued Dec. 5, 1989 shows an eductor system in which a plurality of spray nozzles are provided for the liquid working fluid to wash and clean the inner peripheral surface of a hopper. A cylindrical pipe positioned within the hopper is provided for particulate material. The liquid working fluid discharged from the nozzles solves a problem in which dry hydratable solids were plugging the throat of the eductor to make frequent cleaning necessary. The swirling action in the hopper is provided to ensure all the surfaces of the hopper wall are washed with the liquid, not to create a suction at the end of the outlet pipe for the particulate material. The outlet pipe for the dry particulate material does not have a nozzle and a suction is applied to the lower end of the hopper, not at the lower end of the pipe for the dry particulate material.

It is desired that an eductor system for mixing two separate components, one of which is a liquid, be provided in which a liquid working fluid is directed into a swirling movement in a vortex chamber prior to contact and mixing with the other constituent or component so that a rapid and continuous intimate mixing of the liquid and other component is obtained in a mixing chamber adjacent the outlet nozzle for the other component.

SUMMARY OF THE INVENTION

The eductor system of the present invention is directed to an apparatus and method for the continuous mixing of a liquid with a separate component, such as another liquid or a particulate material. When the separate component is particulate material, a slurry is formed. The term "slurry" is interpreted herein for all purposes as including solutions and dispersions. The term "particulate material" is interpreted herein for all purposes as including granular and powdered materials or other pressure transportable or fluidizable materials. The liquid is the working fluid which provides the motive fluid power and is first directed into the annulus of a vortex chamber in which a swirling vortex movement of the liquid is created prior to mixing with the dry particulate material. A conduit for the dry particulate material is mounted within the vortex chamber and has an inner discharge nozzle at the end of the conduit. A restriction or constriction is formed between the outer surface of the inner nozzle and a concentric outer nozzle forming the inner peripheral surface of the vortex chamber through which the swirling liquid flows at an increased velocity to create a suction at the lower end of the dry particulate conduit to suck or draw the particulate material from the conduit for mixing. A mixing chamber is defined below the coaxial nozzles and the swirling liquid mixes with the dry particulate material to form a slurry. The slurry may be transported to a suitable predetermined location for storage or use.

To provide a swirling movement to the liquid, the vortex chamber is formed of a generally cylindrical shape and a liquid supply conduit extends in a perpendicular direction to the longitudinal axis of the cylindrical vortex chamber. The entrance opening for the liquid to the vortex chamber is adjacent the inner peripheral surface of the vortex chamber and tapers to conform to the peripheral surface of the vortex chamber with the liquid being directed along the inner peripheral surface of the vortex chamber for creating a swirling liquid stream in the vortex chamber. The liquid supply conduit changes from a circular cross section to a rectangular cross section at the entrance opening to the vortex chamber to provide a relatively smooth transition with minimal irregular motion. The cross sectional area of the tangential entrance opening for the liquid thus has a transition from a circular to rectangular shape that provides a thin layer or sheet of liquid fluid with a uniform pressure/velocity profile for entering the vortex chamber of the mixing apparatus. An annulus is provided in the vortex chamber between the outer surface of the vortex chamber and the conduit for the dry particulate material.

The liquid flow is the primary fluid flow and the suction flow of the particulate material is the secondary flow. The swirling motion of the liquid is a spinning helical motion. Swirl is the circumferential velocity component that will cause a fluid stream to rotate about its axis. Swirl changes energy momentum into centrifugal force that will cause a rotating stream to have three velocity components; a) axial, b) circumferential and c) radial. The circumferential velocity will move the heavier or more dense material (solids) or liquid to the outside while the radial velocity will move the lighter constituents to the inside toward the longitudinal axis. The introduction of swirl enhances mixing due in part to an increase in turbulence. Swirl imparts radial acceleration to particles, modifying their motion and dispersion behavior, and enhances interfacial contact between two or more constituents due to stretching, straining and folding of particles and droplets to form a uniform mixture. The total energy in a steadily flowing fluid is constant along its flow path and as the velocity of the fluid increases the pressure within the fluid decreases. The intense swirling motion of the pressurized liquid when it enters the vortex chamber provides a sheet of liquid that has a uniform pressure profile. When the liquid helical stream passes through a constriction, slower moving fluid adjacent the surfaces defining the constriction forms an energized boundary layer to reduce frictional drag or a shear layer resulting in a more efficient pressure recovery.

A diffuser structure defines an outer coaxial concentric outer nozzle about the inner nozzle of the conduit for the particulate material to provide a swirl mixing chamber downstream of the inner nozzle to effect intermingling of the liquid and dry particulate material for discharge into the mixing chamber. The diffuser structure includes an upper or upstream converging portion defining the outer coaxial nozzle, a small length cylindrical or throat portion, and a lower or downstream diverging portion. The outer coaxial nozzle is arranged about and in concentric relation to the nozzle of the particulate material conduit and defines an inner surface extending at a converging angle preferably about thirty (30) degrees relative to the longitudinal axis of the conduit to form a gap or constriction between the coaxial nozzle of the conduit and the diffuser structure. The cylindrical throat portion is of a relatively small length and the diverging outlet portion is preferably at an angle of about thirty (30) degrees relative to the longitudinal axis of the conduit. A relatively large mixing chamber is defined below the diverging portion.

A relatively narrow annular gap or constriction from the liquid is formed between the outer nozzle and the inner nozzle to provide an increase in the velocity of the downward moving liquid stream in a swirling helical path. The narrow annular gap provides a venturi effect and the pressurized liquid has a high velocity when flowing through the gap and the diffuser structure. The outer periphery of the discharge nozzle for the particulate material may be formed with a plurality of spaced slotted portions to form lobes which are effective in generating turbulence for the liquid flowing downward in a helical path from the vortex chamber past the gap between the nozzles. The lobes provide varying velocities to the liquid to effect increased interfacial contact between the liquid and the particulate material to provide a more efficient mixing. A swirling action imparts acceleration to particles modifying their motion and dispersion behavior. Improved mixing is attributed to the increased liquid and particulate material interaction formed in a vortex. Turbulent flow provides a mechanism for mixing a slower fluid near an inner wall surface with a faster fluid adjacent an outer wall surface. A turbulent boundary layer is more resistant to such a wall separation than a laminar layer. By accelerating the fluid near a wall surface, the character of the velocity profile becomes more negative, and wall separation is avoided.

The particulate material to be mixed with a liquid may comprise various materials and chemical additives, such as cement, oil well drilling muds, polymers, diatomaceous earth, talc, lime, paint pigments, powdered fire retardant materials, and other similar types of materials. Oftentimes, the particulate material is mixed with a liquid upon unloading of the particulate material from a container or other storage facility to form a slurry which may be transported to a predetermined location for use or for storage.

An object of the present invention is to provide an apparatus and method for an eductor system for the continuous mixing of a liquid with a separate component to form a generally uniform mixture.

A further object of the invention is to provide such an apparatus and method in which a liquid is first directed into a vortex chamber to provide a swirling vortex movement for subsequent mixing with another separate component to provide improved mixing of the liquid and separate component.

A further object of the invention is to provide such an apparatus and method in which a conduit for a particulate material extends axially within a vortex chamber and has a lower inner nozzle defining a gap between the inner nozzle and an outer concentric nozzle of the vortex chamber to increase the velocity of the liquid at the gap thereby to provide a suction for the particulate material for improved mixing of the liquid with the particulate material.

Another object of the invention is to provide an apparatus and method in which irregular surfaces are provided in the annular gap or constriction between the concentric coaxial nozzles to provide varying velocities in the liquid thereby to cause increased interfacial contact between the liquid and dry particulate material to provide a more efficient mixing.

Other objects include providing a passive method of energizing the fluid boundary layer in a conically shaped diffuser, providing a method to reduce viscous drag with a diffuser having a short throat, and providing a method that generates a vacuum with a nozzle fluid velocity of about 60 feet per second and an operating pressure drop of 25 psig.

Other objects, features, and advantages of the invention will become more apparent from the following specification and drawings.

DESCRIPTION OF THE INVENTION

Figure 1:
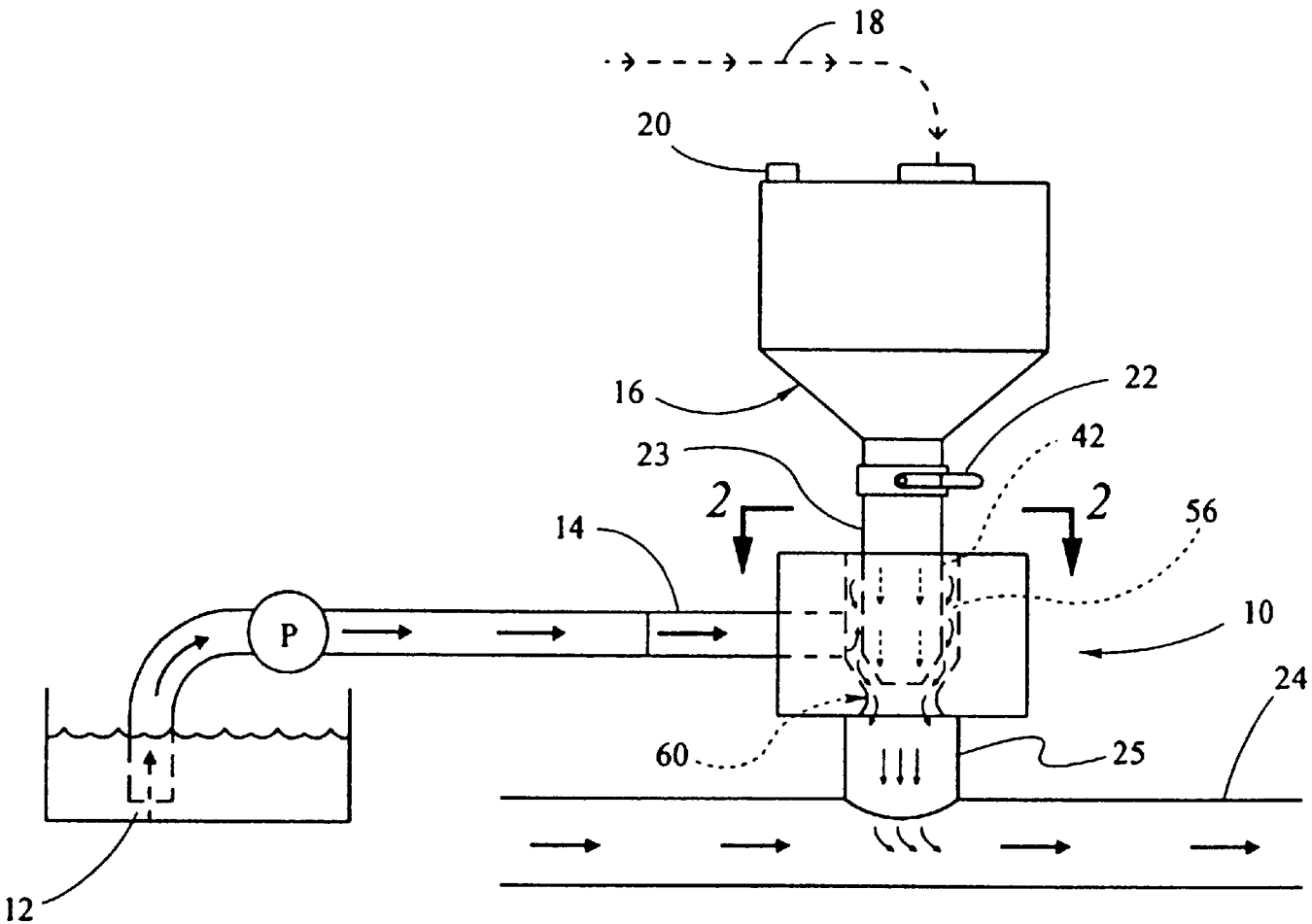
FIG. 1 is a generally schematic view of the eductor system of the present invention utilizing a mixing device for mixing a liquid with a separate component.
Figure 2:
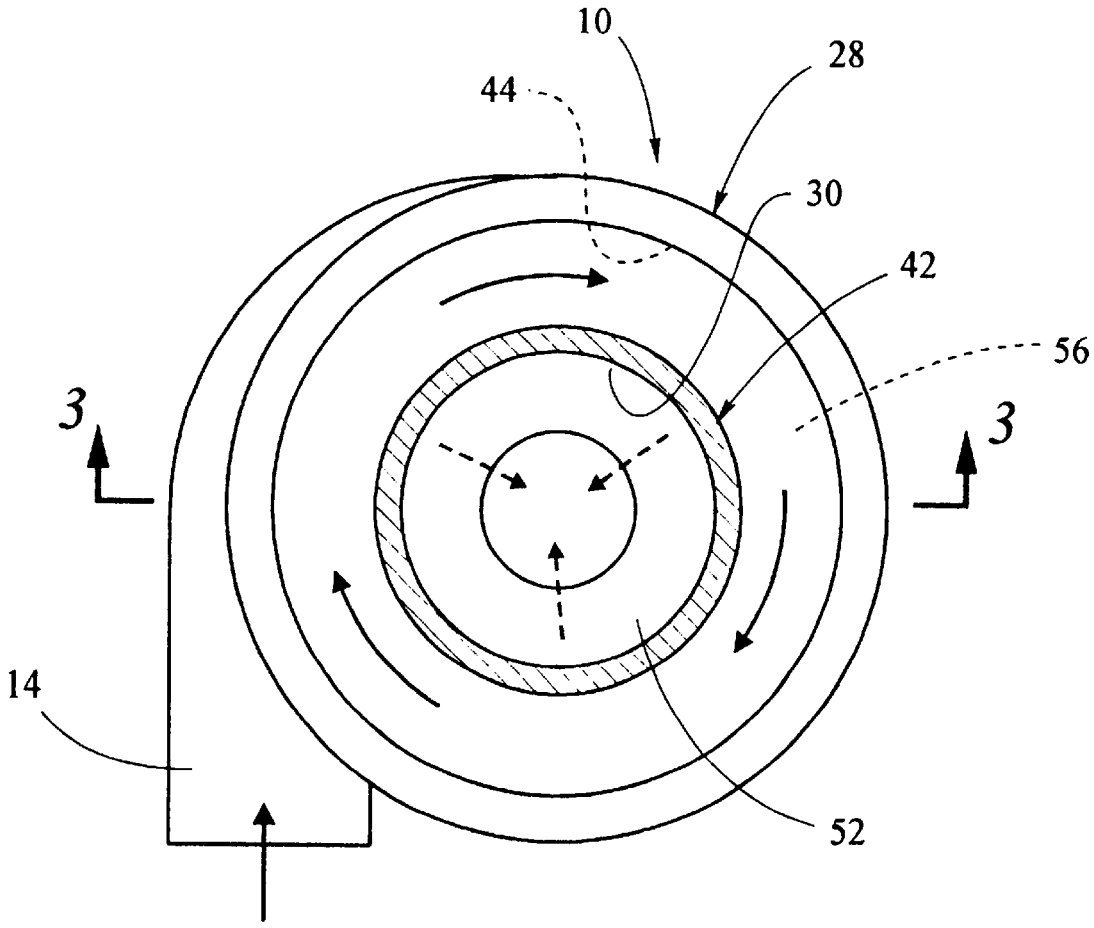
FIG. 2 is a top plan of the eductor mixing device shown in FIG. 1 taken generally along line 2—2 of FIG. 1.

The present invention as illustrated in the drawings shows an eductor system for liquid and particulate material. Referring now particularly to FIG. 1 which shows schematically the eductor system of the present invention, an eductor mixing device is shown generally at 10 mounted for mixing of a liquid and a particulate material. A liquid is supplied to the mixing device 10 by a pump P connected to a suitable liquid supply source shown at 12. An inlet liquid conduit for mixing device 10 is shown at 14. A hopper for the particulate material is shown generally at 16 and particulate material may be supplied to hopper 16 through supply conduit 18 by gravity or transported pneumatically or by conveyor, for example. A vent is shown at 20 for venting of hopper 16. A manually operated valve is shown at 22 in inlet conduit or pipe 23 and may be utilized for controlling the flow of particulate material to mixing device 10 as may be desired. The liquid and particulate material are mixed by mixing device 10 to form a slurry which may be discharged through outlet conduit or pipe 25 into a transport conduit 24 for mixing with an additional fluid or for transport to a suitable area for utilization or storage, as may be desired. While mixing device 10 is shown in FIG. 1 as being utilized with one eductor mixing system, it is apparent that mixing device 10 could be utilized independently or with various other types of eductor mixing systems.

Referring now particularly to FIGS. 2-6, eductor mixing device 10 is illustrated and comprises a generally cylindrical main body or housing generally indicated at 28 and defining a generally cylindrical inner surface 30. As shown also particularly in FIG. 5, main body 28 has a central bore defined by inner peripheral surface 30 and upper and lower internally threaded portions 32 and 34. As shown particularly in FIG. 6, an entrance opening 36 of a rectangular cross section for a liquid is formed between a lower planar ledge 38 and a similar upper planar ledge 40 to form an arcuate surface 41 therebetween which tapers and merges with peripheral surface 30. Cylindrical peripheral surface 30 forms a smooth continuation of arcuate surface 41. Liquid inlet conduit 14 is of a circular cross section and a transition section for housing 28 is provided between the circular cross section and the rectangular entrance opening 36 between ledges 38 and 40. Thus, turbulence of a liquid entering body 28 is minimized.

Figure 3:
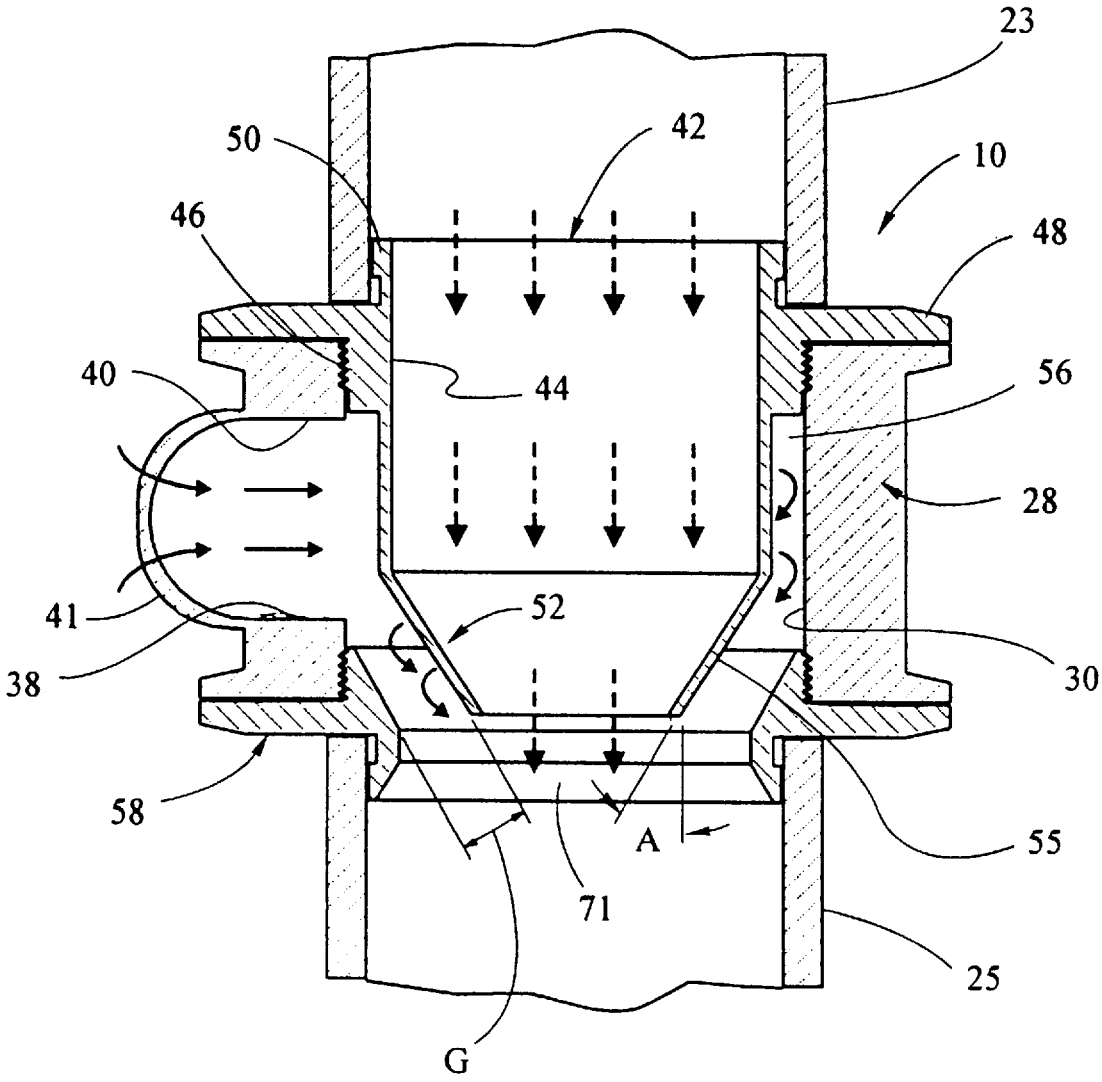
FIG. 3 is a section taken generally along line 3—3 of FIG. 2.

An inner tube is shown generally at 42 to receive the particulate material from hopper 16. Tube 42 has a body 44 with external screw threads 46 and an outer peripheral flange 48. Tube 42 is secured to internal screw threads 32 on main body 30 and flange 48 fits against the upper end of body 28 in sealing relation. Conduit 23 extends between hopper 16 and upper annular rim 50 of inlet tube 42. Inner tube 42 has a lower inner nozzle 52 having a smooth outer frusto-conical converging surface 55 to define a lower opening. Since frusto-conical surface 55 is smooth, turbulence of the swirling liquid is minimized. Outer peripheral surface 55 extends at an angle A of about 30 degrees as shown in FIG. 3 relative to the longitudinal axis of inner tube 42. Angle A may be between about 10 degrees and 45 degrees and obtain satisfactory results under various conditions. A vortex chamber is formed in main body 28 and annulus 56 extends between main body 28 and inner tube 42. Pressurized liquid entering body 28 from entrance opening 36 along arcuate surface 41 descends in a swirling helical path about inner tube 42 in annulus 56.

Figure 4:
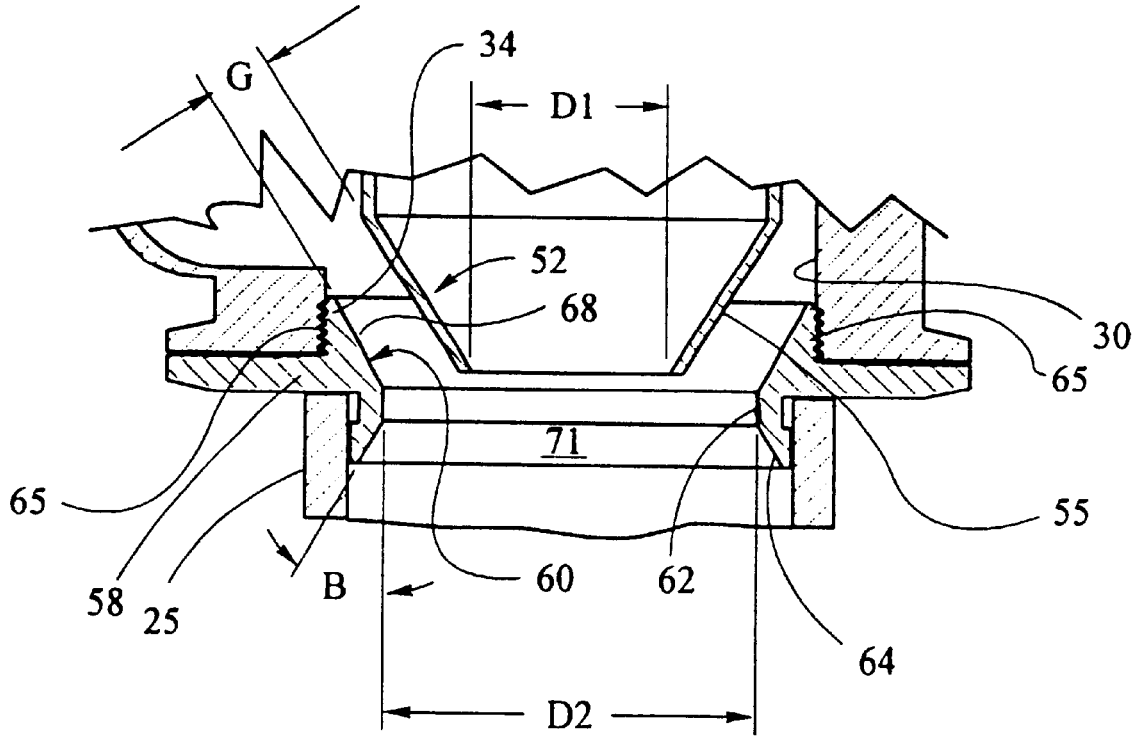
FIG. 4 is an enlarged sectional view of a fragment of FIG. 3 showing the annular gap between the inner discharge nozzle for a particulate material and the adjacent outer coaxial nozzle of the diffuser ring for increasing the velocity of a swirling liquid for mixing with the particulate material at the discharge end of the discharge material nozzle.
Figure 5:
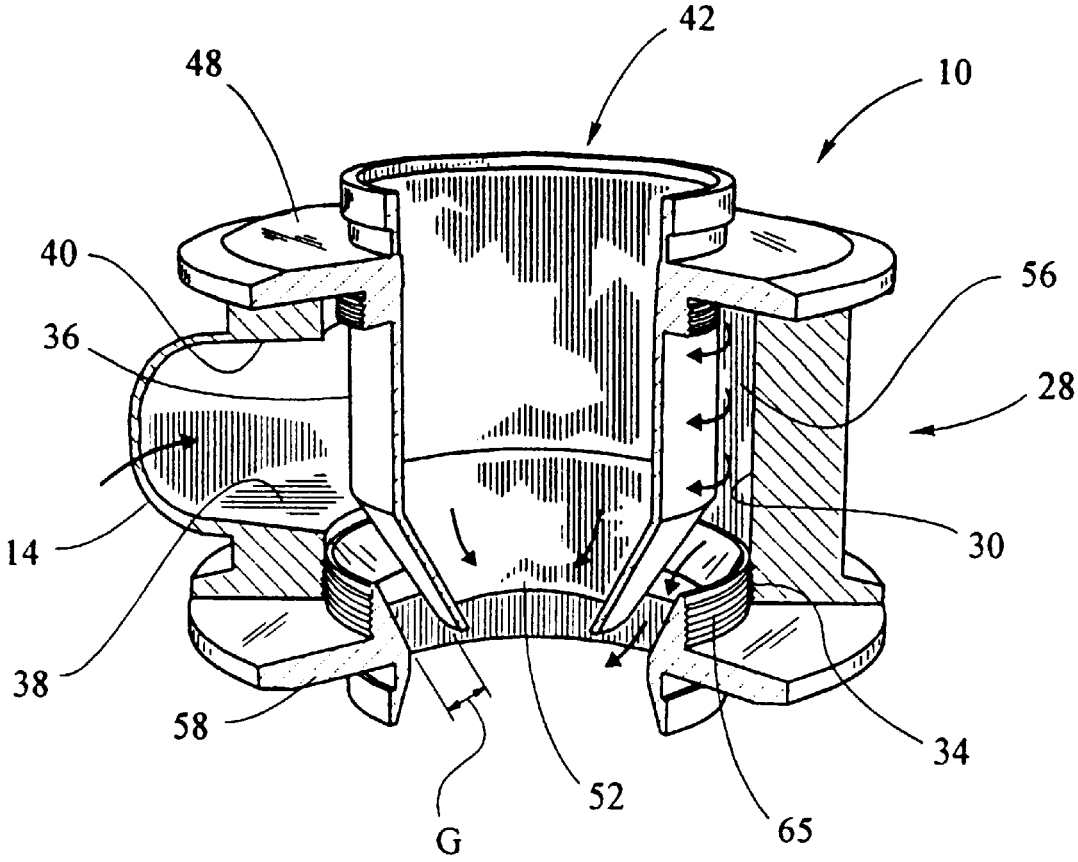
FIG. 5 is a perspective of the mixing device with certain parts broken away and showing the mixing device removed from the eductor system.
Figure 6:
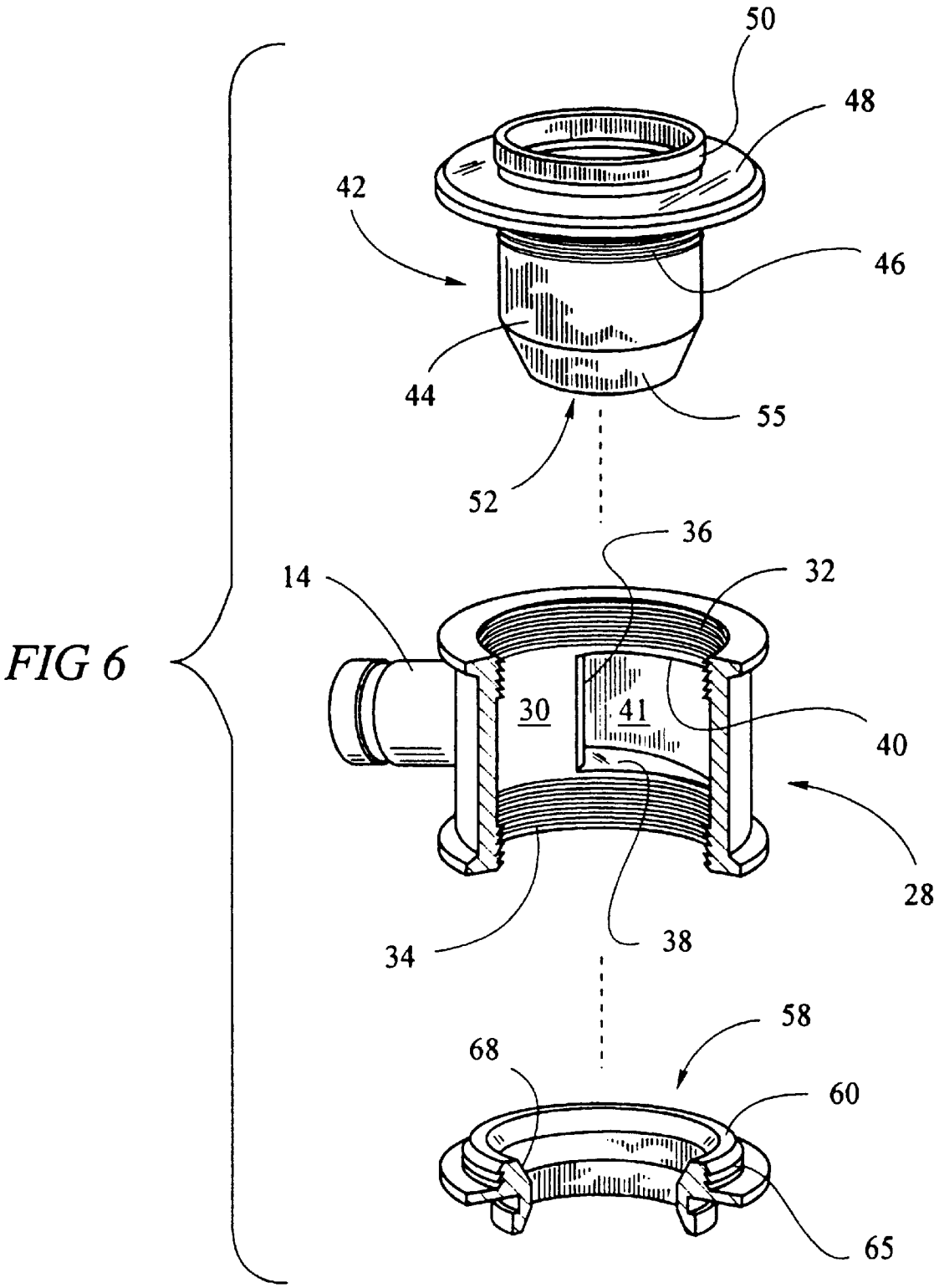
FIG. 6 is an exploded view of the mixing device shown in FIG. 5 showing the outer housing, inner tube for the particulate material, and lower diffuser ring.

For mixing and intermingling of the swirling liquid with the particulate material when the particulate material is discharged from the lower end of inner nozzle 52, a diffuser ring shown generally at 58 is mounted adjacent to the lower end of main body 28. Diffuser ring 58 as shown particularly in FIG. 4 has an upper converging section defining an outer nozzle 60, a cylindrical throat 62, and a lower diverging section 64. An annular gap or constriction G is formed between the concentric coaxial nozzles 52 and 60. The outer periphery of diffuser ring 58 has external screw threads 65 for engaging internal threads 34 on main cylindrical body 28 of mixing device 10. Nozzles 52 and 60 are coaxial and the inner peripheral surface 68 of nozzle 60 is in concentric parallel relation to outer frusto-conical surface. 55 on nozzle 52. Thus, angle A would apply equally to nozzle 60. Gap G formed between coaxial nozzles 52, 60 and coaxial concentric frusto-conical surfaces 55 and 68 preferably may have a width of about ½ inch for an internal diameter D1 of about two inches for the discharge opening of nozzle 52 to provide a ratio of about four to one between diameter D1 and gap G. A ratio between about two to one and eight to one between diameter D1 and gap G would function satisfactorily under various conditions. Gap G may be adjusted in width by providing a plurality of interchangeable diffuser rings 58 with different selected diameters D2 thereby to vary the velocity of the fluid passing through gap G. The width of gap G could also be varied by adjustments between threads 34 and 65. The width of annular gap G as shown in FIG. 4 is selected to provide a minimum velocity of 60 feet per second for the relative volume of liquid pumped. Thus, the width of gap G is adjusted to provide a predetermined flow rate for the liquid.

Throat 62 has an inner cylindrical surface to define inner diameter D2 and extends downwardly a distance of about ½ inch. The length of throat 62 may vary between about ¼ inch and about 2 inches for a diameter D2 of about 2 inches. Diameter D2 of throat 62 is larger than diameter D1 and is preferably about 2½ inches for a diameter D1 of 2 inches. Diameter D2 may vary between about 1.2 times diameter D1 and 2.0 times diameter D1 for satisfactory results as determined by the flow rate. Lower diverging section 64 of diffuser ring 58 has an inner peripheral frusto-conical surface which slopes at an angle B of about 30 degrees relative to the longitudinal axis of diffuser ring 58. Angle B between about 15 degrees and 45 degrees would function adequately under various conditions. A mixing chamber 71 for the mixing and intermingling of the particulate material and liquid for forming a slurry. The mixing is at a maximum adjacent the lower end of nozzle 52 and decreases as the mixture flows downwardly in conduit 25. A vacuum is exerted adjacent the lower end of nozzle 52 at mixing chamber 71 with a nozzle fluid velocity of about 60 feet per second and an operating pressure drop of 25 psig. The width of gap G is selected to provide a liquid between about 60 feet per second and 120 feet per second dependent on characteristics or functions of the liquid, such as density, flow rate, and viscosity.

Operation

In operation, a pressurized liquid, such as water, is pumped by pump P through rectangular opening 36 into annular vortex chamber 56 between particulate inlet tube 42 and the main body 28 of mixing device 10. The liquid moves along arcuate surface 41 and then along cylindrical surface 30 in a smooth transition with minimal turbulence for creating a swirling movement in a descending helical path of the liquid to gap G formed between nozzles 52 and 60. The velocity of the swirling liquid increases as the swirling liquid moves downwardly along gap G and the parallel frusto-conical surfaces 55 and 68 which are positioned at a preferred converging angle of about 30 degrees with respect to the longitudinal axis of the particulate tube 42. As the swirling liquid passes downwardly below the lower end of converging nozzle 52, a suction is created by the liquid to draw or suck the particulate material from particulate inner tube 42. The swirling liquid passing through gap G at a relatively high velocity and strong vortex is effective in obtaining a high interfacial contact with the particulate material as the particulate material passes downwardly from nozzle 52. A mixing chamber 71 for the liquid and the particulate material is created adjacent the end of nozzle 52 and particularly in diffuser ring 58 for an intimate, continuous mixing action in a relatively short length of travel after the particulate material is discharged from the lower end of nozzle 52.

Gap G formed by coaxial concentric frusto-conical surfaces 55 and 68 is of a uniform width or thickness between about ¼ inch and one inch. Internal diameter D1 of nozzle 52 is between three and eight times the width of gap G. The frusto-conical surfaces 55 and 68 extend at an angle A relative to the longitudinal axis of tube 42. The height of the vortex chamber 56 is relatively small and thereby provides a swirling motion of the liquid in a minimal time period. The velocity of the liquid passing through diffuser ring 58 adjacent the lower end of nozzle 52 varies with the pressure of the liquid and increases in velocity with an increase in fluid pressure. For example, with the liquid having fluid pressure of about 25 psi, a velocity of 61 feet per second is obtained. With a fluid pressure of 40 psi, a velocity of 75 feet per second is obtained.

Figure 7:
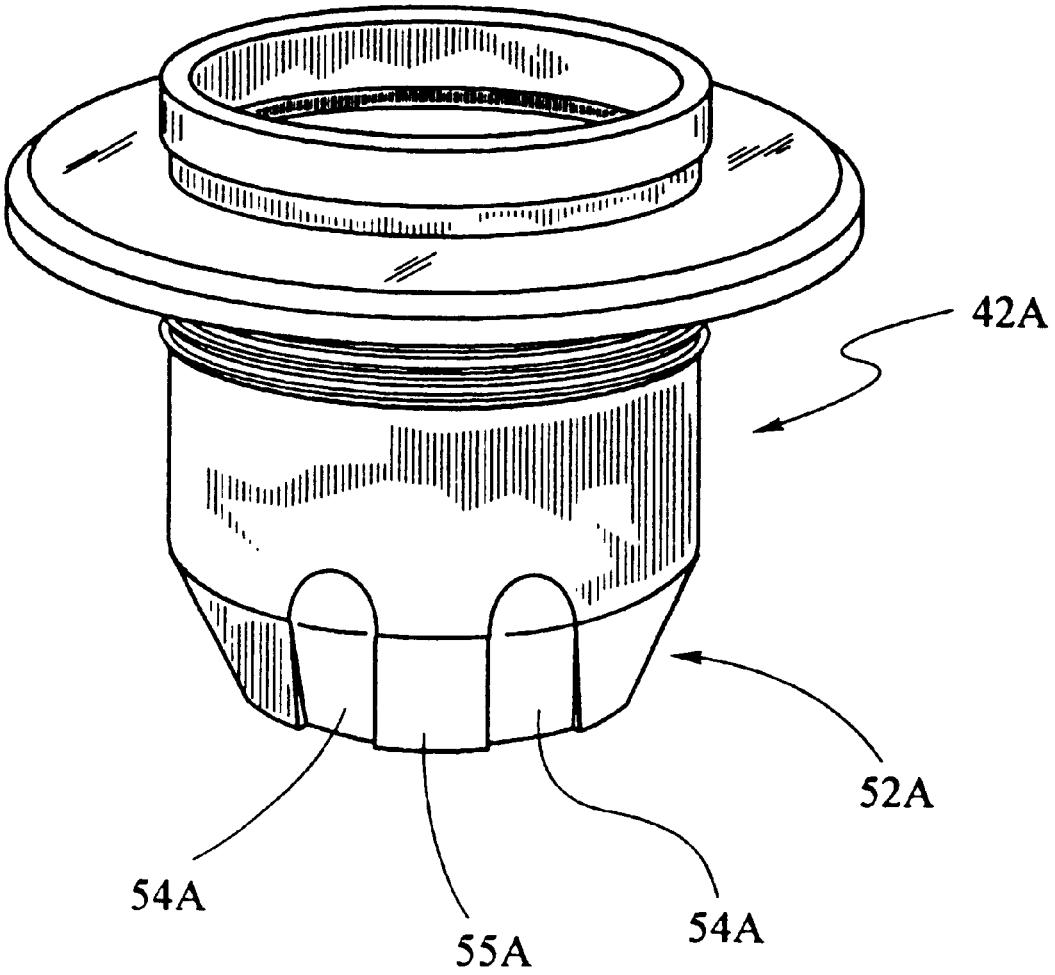
FIG. 7 is a perspective view of a modified inlet tube for the particulate material in which the discharge nozzle for the particulate material is provided with lobes to provide a turbulent liquid flow.

Referring now to FIG. 7, a modified inlet 42A for particulate material is shown in which nozzle 52A has a smooth frusto-conical outer surface 55A. Converging nozzle 52A has a plurality of equally spaced lobes 54A along the outer surface 55A. Lobes 54A are effective to provide a turbulence to the swirling liquid moving in a spiral path about nozzle 52A. The turbulence of the swirling liquid improves intermingling of the liquid and particulate material adjacent the end of nozzle 52A. The remainder of inner tube 42A is similar to inlet tube 42 of the embodiment shown in FIGS. 2-6.

Mixing device 10 has been illustrated in the drawings as directed to the mixing of a liquid with a particulate material. The present invention is also applicable to mixing a liquid with another separate component such as another liquid or a compressible fluid, such as a gas. The separate component is discharged from inner tube 42 into the swirling liquid stream from vortex chamber 56 and intimately mixed in the mixing chamber 71 adjacent the lower end of nozzle 52. Diameters D1, D2 and gap G may vary dependent primarily on the characteristics of the separate component and the liquid such as flow rate, fluid density, and viscosity of the liquid.

While eductor mixing device 10 has been illustrated in the drawings as extending in a vertical direction, it is understood that eductor mixing device 10 may extend in various directions and the terms "upper" and "lower" are to be interpreted as covering the opposed ends of the mixing device 10. Also, while mixing device 10 has been illustrated as comprising three separate elements, such as main body 28, particulate inlet tube 42, and diffuser ring 58, mixing device 10 could be formed of various elements for assembly by various means, Further, mixing device 10 could be formed of various materials, such as metallic material or various plastic materials without adversely affecting the function of the eductor mixing device.

While preferred embodiments of the present invention have been illustrated in detail, it is apparent that modifications and adaptations of the preferred embodiments will occur to those skilled in the art. However, it is to be expressly understood that such modifications and adaptations are within the spirit and scope of the present invention as set forth in the following claims.

What is claimed is:

1. Apparatus for mixing a liquid with a separate component comprising:

a body having an axial bore therethrough and a cylindrical inner surface;

a liquid conduit in fluid communication with said axial bore and extending axially in a substantially perpendicular relation to said axial bore, said liquid conduit having an outer circular cross section and an inner generally rectangular cross section, and an inlet opening to said body gradually tapering and conforming to the inner peripheral surface of said cylindrical body;

a separate conduit for said separate component received within said body in concentric coaxial relation to said body and forming an annulus between said separate conduit and said body, said liquid conduit having a discharge outlet in fluid communication with said annulus for the supply of the liquid in a relatively smooth helical path along said cylindrical inner surface of said body, said separate conduit having a converging lower end portion to form an inner nozzle; and an annular diffuser member adjacent the lower end of said body extending in concentric relation to said inner nozzle of said body extending in concentric relation to said inner nozzle of said separate conduit and defining a relatively narrow annular space therebetween for the passage of liquid and the separate component in a swirling action with a swirl chamber formed downstream of said inner nozzle for mixing of said liquid said separate component, said annular space between said inner nozzle and said adjacent diffuser member being of a uniform thickness and formed between adjacent parallel surfaces of said diffuser member and said nozzle, said nozzle space forming a venturi with the swirling liquid mixing with said separate component upon flow through the venturi.

2. Apparatus for mixing a liquid with a separate component as defined in claim 1 further comprising:

a mixing chamber defined downstream of said inner nozzle and venturi for further mixing of said liquid and said separate component; and a discharge conduit downstream of said mixing chamber for transport of the mixed liquid and separate component to a predetermined location.

3. Apparatus for mixing a liquid with a separate component as defined in claim 1 wherein said separate component comprises particulate material and forms a slurry when mixed with said liquid.

4. Apparatus for mixing a liquid with a separate component as defined in claim 1 wherein said separate component comprises a liquid.

5. Apparatus for mixing a liquid with a separate component as defined in claim 1 wherein said separate component comprises a compressible fluid.

6. Apparatus for mixing a liquid with a separate component as defined in claim 1 wherein said relatively narrow annular space forms a gap of a predetermined width, said inner nozzle having a discharge opening of an inner diameter between two and eight times the width of said gap.

7. Apparatus for mixing a liquid with a separate component as defined in claim 1, wherein said liquid conduit has a transition section extending from a generally circular cross-section of said liquid conduit to a generally rectangular outlet opening to said annulus, said rectangular opening defining an outer peripheral surface extending longitudinally in an arcuate path and a pair of opposed parallel planar ledges adjacent said outer peripheral surface, said ledges tapering in width from said rectangular opening for merging into said cylindrical inner surface of said body to form a smooth continuation of said outer peripheral surface of said transition section to minimize turbulence.

8. Apparatus for mixing a liquid with a particulate material to form a slurry, and comprising:

a body having an axial bore therethrough defining a generally cylindrical inner peripheral surface;

a material conduit for particulate material received within said axial bore and forming an annulus between said material conduit and said body, said material conduit having a converging lower end portion to define a nozzle for said material conduit;

a liquid conduit in fluid communication with said axial bore and extending axially in a generally perpendicular relation to said axial bore, said liquid conduit having a transition section extending from a generally circular cross section of said conduit to a generally rectangular cross section thereof, said generally cylindrical inner peripheral surface of said body forming a smooth continuation of the outer peripheral surface defining said transition section; and an annular diffuser member adjacent the other end of said outer body in concentric relation to said inner nozzle and defining a relatively narrow annular gap therebetween fort he passage of liquid therethrough in a swirling helical path with a swirl mixing chamber formed downstream of said nozzle for mixing of said liquid and particulate material, said gap defining a venturi for increasing the velocity of the liquid passing through said gap and being of a uniform thickness formed between adjacent parallel surfaces of said nozzles.

9. Apparatus as defined in claim 8 wherein a generally rectangular outlet opening to said annulus is defined by said generally rectangular cross section, said outlet opening defining an outer arcuate peripheral surface and a pair of opposed planar ledges adjacent said arcuate peripheral surface, said ledges tapering in width for merging into said inner peripheral surface of said body.

10. The apparatus as defined in claim 8 wherein said inner nozzle is of a generally frusto-conical shape, said diffuser member having an outer nozzle positioned in concentric relation to said inner nozzle of said particulate material conduit to define said gap therebetween.

11. The apparatus as defined in claim 8 wherein said diffuser member has a generally cylindrical throat downstream of said outer liquid nozzle and integral therewith.

12. The apparatus as defined in claim 11 wherein said diffuser member has an inverted frusto-conical lower end portion flaring outwardly from said throat to define an outlet for said diffuser member.

13. Apparatus for mixing a liquid with a separate component comprising:

a body having an axial bore therethrough and a cylindrical inner surface;

a liquid conduit in fluid communication with said axial bore and axially in a substantially perpendicular relation to said axial bore;

a separate conduit for said separate component received within said body in concentric coaxial relation to said body and forming an annulus between said separate conduit and said body, said liquid conduit having a discharge outlet in fluid communication with said annulus for the supply of the liquid in a relatively smooth helical path along said cylindrical inner surface of said body, said separate conduit having converging lower end portion to form an inner nozzle; and an annular diffuser member adjacent the lower end of said body extending in concentric relation to said inner nozzle of said separate conduit and defining a relatively narrow annular space therebetween for the passage of liquid and the separate component in a swirling action with a swirl chamber formed downstream of said inner nozzle for mixing of said liquid and said separate component, said annular space forming a venturi with the swirling liquid mixing with said separate component upon flow through the venturi, said diffuser member defining an upstream converging section to form an outer liquid nozzle, a contiguous generally cylindrical throat section, and a downstream diverging section; said annular space defining said venturi formed between said outer liquid nozzle of said diffuser member and said inner nozzle of said separate conduit.

14. Apparatus for mixing a liquid with a separate component as defined in claim 13 wherein said downstream diverging section is positioned downstream of said inner nozzle.

15. Apparatus for mixing a liquid with a separate component comprising:

a body having an axial bore therethrough and a cylindrical inner surface;

a liquid conduit in fluid communication with said axial bore and extending axially in a substantially perpendicular relation to said axial bore;

a separate conduit for said separate component received within said body in coaxial relation to said body and forming an annulus between said separate conduit and said body, said liquid conduit having a transition section extending from a generally circular cross-section of said liquid conduit to a generally rectangular outlet opening to said annulus, said rectangular opening defining an outer peripheral surface extending longitudinally in an arcuate path and a pair of opposed parallel planar ledges adjacent said outer peripheral surface, said ledges tapering in width from said rectangular opening for merging into said cylindrical inner surface of said body in a smooth continuation of said outer peripheral surface of said transition section, said separate conduit having a converging lower end portion to form an inner nozzle; and an annular diffuser member adjacent the lower end of said body extending in concentric relation to said inner nozzle of said separate conduit and defining a relatively narrow annular space therebetween for the passage of liquid and the separate component in a swirling action with a swirl chamber formed downstream of said inner nozzle for mixing of said liquid and said separate component, said annular space forming a venturi with the swirling liquid mixing with said separate component upon flow through the venturi.

16. Apparatus for mixing a liquid with a separate component as defined in claim 15, wherein said annular space between said inner nozzle and said adjacent diffuser member is of a uniform thickness and formed between adjacent parallel surfaces of said diffuser member and said inner nozzle.

17. Apparatus for mixing a liquid with a separate component as defined in claim 15, wherein said separate conduit has a plurality of lobes spaces about an outer peripheral surface of said inner nozzle to generate turbulence in the liquid flowing downward through said annular space.

18. Apparatus for mixing a liquid with a separate component as defined in claim 17, wherein said separate conduit has an outwardly extending flange seated tightly with an upper end of said body.

19. Apparatus for mixing a liquid with a separate component as defined in claim 18, wherein said annular diffuser member has an outer flange in contact with said lower end of said body and is tightly seated against said lower end of said body.

20. Apparatus for mixing a liquid with a separate component as defined claim 17 wherein said inner nozzle and outer nozzle are of a frustoconical shape and extend in a parallel relation to each other.

* * * * *